US007806594B2

(12) United States Patent
Trinko

(10) Patent No.: US 7,806,594 B2
(45) Date of Patent: Oct. 5, 2010

(54) DELI BAG WITH ADHESIVE STRIP

(76) Inventor: Thomas J. Trinko, 552 Riverway, Menasha, WI (US) 54952

( * ) Notice: Subject to any disclaimer, the term of this patent is extended or adjusted under 35 U.S.C. 154(b) by 1336 days.

(21) Appl. No.: 11/260,725

(22) Filed: Oct. 27, 2005

(65) Prior Publication Data

US 2006/0078232 A1 Apr. 13, 2006

Related U.S. Application Data

(63) Continuation-in-part of application No. 10/715,052, filed on Nov. 17, 2003, now abandoned.

(60) Provisional application No. 60/623,061, filed on Oct. 28, 2004, provisional application No. 60/624,708, filed on Nov. 3, 2004.

(51) Int. Cl.

| | |
|---|---|
| ***B65D 30/00*** | (2006.01) |
| ***B65D 33/14*** | (2006.01) |
| ***B65D 33/24*** | (2006.01) |
| ***B65D 1/34*** | (2006.01) |
| ***A63B 55/04*** | (2006.01) |

(52) U.S. Cl. ..... 383/37; 383/22; 383/86; 206/554; 248/97

(58) Field of Classification Search ..... 383/37, 383/84, 62, 9, 95, 22, 86; 206/554; 248/97
See application file for complete search history.

(56) References Cited

U.S. PATENT DOCUMENTS

| | | | | |
|---|---|---|---|---|
| 3,070,280 | A | 12/1962 | Richmond | |
| 3,353,661 | A | 11/1967 | Membrino | |
| 4,458,466 | A | 7/1984 | Carbone et al. | |
| 4,502,599 | A * | 3/1985 | Perecman | 206/554 |
| 4,785,940 | A * | 11/1988 | Wilson | 383/84 |
| 5,014,852 | A * | 5/1991 | Herrington et al. | 206/554 |
| 5,044,772 | A * | 9/1991 | Larson | 383/11 |
| 5,100,000 | A * | 3/1992 | Huseman | 206/554 |

* cited by examiner

*Primary Examiner*—Jes F Pascua
(74) *Attorney, Agent, or Firm*—Quarles & Brady LLP

(57) ABSTRACT

A bag for holding perishable foods for transportation to a consumer's home includes an adhesive disposed on a flap of the bag to be folded down to cover the bag's opening. The adhesive can be used to bind multiple deli bags together for dispensing as well as to seal the bag for transportation of foodstuffs.

12 Claims, 4 Drawing Sheets

DELI BAG WITH ADHESIVE STRIP

CROSS-REFERENCE TO RELATED APPLICATION

This application claims the benefit of U.S. Provisional Patent Application Ser. No. 60/623,061, filed Oct. 28, 2004, and entitled "DELI BAG HELD FOR DISPENSING BY ADHESIVE STRIP" and U.S. Provisional Patent Application Ser. No. 60/624,708, filed Nov. 3, 2004, and entitled "BAG END MARKING SYSTEM" and is a continuation-in-part of U.S. patent application Ser. No. 10/715,052, filed Nov. 17, 2003, now abandoned and entitled "DISPENSABLE RESEALABLE BAG FOR FOOD."

STATEMENT REGARDING FEDERALLY SPONSORED RESEARCH OR DEVELOPMENT

Not applicable.

BACKGROUND OF THE INVENTION

The present invention relates generally to resealable plastic bags and, in particular, to a bag well suited for packaging of food commonly found in a deli or the like.

Plastic bags constructed of films of polyester, polypropylene, or the like are well suited for storage of food items. That is, bags constructed from these materials provide an inexpensive material that is both hygienic and liquid-tight. In particular, in retail establishments such as delicatessens or grocery stores, it is common to provide a stack of plastic bags that are held together on a rack or similar dispenser by a tab attached to each bag through a perforation. In this regard, the bag may be removed from the tab and rack by breaking the perforation. Once removed, food can then be inserted into the bag and sealed within the bag by way of a separate sticker or the like. Alternatively, some dispensing systems present the bag in a position conducive to inserting the food within the bag prior to removal of the bag from the rack by breaking the perforation. In either case, such bags can be inconvenient because they require a rack for the bags and a separate rack for dispensing the stickers. Navigating this multi-rack system can be cumbersome for food handling personnel who may be wearing gloves.

Additionally, the consumer purchasing the food may wish to store the food in the bag after consuming only a portion of the food. Generally, however, the bag is not resealable, requiring the consumer to use a separate container or to have stickers or other sealing means. Bags that can be resealed after each use are known in the art and quite popular among consumers. One style of bag has a molded plastic zipper-style seal. Nevertheless, these bags are relatively expensive to manufacture. Further, they can be difficult to fill and seal by workers wearing gloves who must separate the opening, support the bag during filling, and operate the zipper.

It would therefore be desirable to have a low-cost food storage bag that is quickly and easily filled, dispensed, and sealed.

BRIEF SUMMARY OF THE INVENTION

The present invention overcomes the aforementioned drawbacks by providing an inexpensive resealable bag where the resealing is provided by a tacky adhesive that seals the bag and holds it for dispensing and filling.

In accordance with one aspect of the invention, a perishable food packaging dispenser is disclosed that includes a plastic bag having a flap designed to fold over an entry passage into the plastic bag and an adhesive strip disposed on the flap to secure the flap to the plastic bag when folded over the entry passage. The perishable food packaging dispenser also includes another, similarly designed plastic bag and a connecting tab to which both plastic bags are removeably secured through the adhesive strip.

The perishable food packaging dispenser may also include a dispensing stand having a opposing sloped side walls that are joined at respective upper ends by a generally horizontal upper wall. Accordingly, the connecting tab may be arranged over the upper wall to position the plastic bags with the entry passages facing away from the sloped side walls.

In accordance with another aspect of the invention, a packaging dispenser is disclosed that includes a plurality of plastic bags having pouches below flaps. An adhesive strip is disposed on each flap. A first plastic bag is secured to a connecting tab via an adhesive strip or a perforation and the remaining plastic bags are stacked upon the first bag and secured to the flap of an adjacent bag through the adhesive strip disposed on each flap.

In accordance with yet another aspect of the invention, a flexible package for food is disclosed that includes a plastic bag engaged through a perforation to a tab. The plastic bag includes an adhesive arranged to seal the plastic bag when removed from the tab. A plurality of plastic bags that are secured together through respective adhesives are stacked on the plastic bag and secured to the tab through the adhesive and perforation.

Various other features of the present invention will be made apparent from the following detailed description and the drawings.

DETAILED DESCRIPTION OF THE PREFERRED EMBODIMENT

The present invention includes a deli bag for holding lunch meats and the like and a system and method for dispensing the bag. The bag includes an adhesive to secure a flap of the bag when folded down to cover the bag's opening. According to one embodiment, the adhesive is used to bind multiple deli bags together for dispensing as well as to seal an individual bag for transportation of foodstuffs contained therein.

Figure 1:
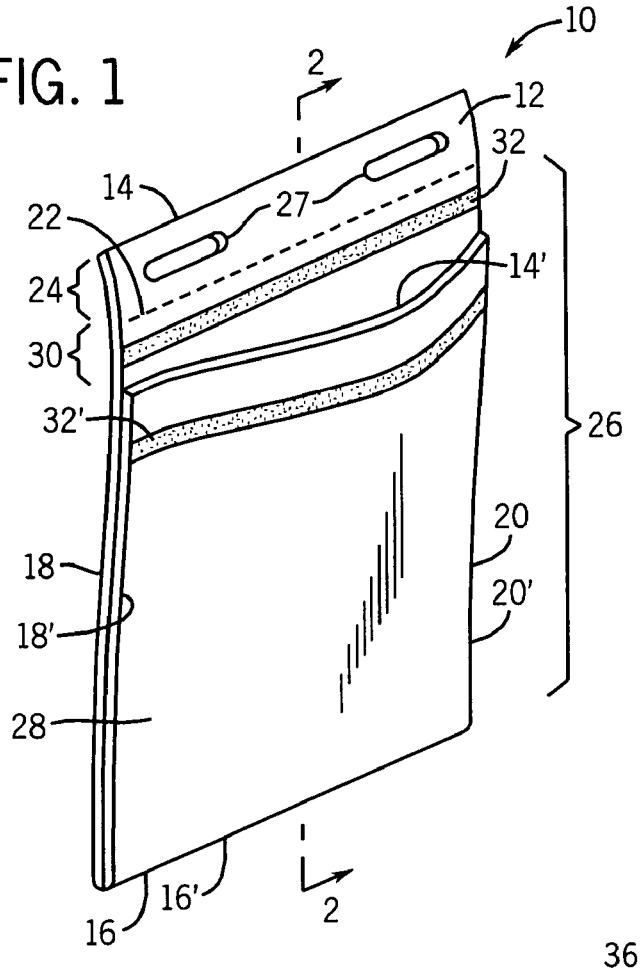
FIG. 1 is a perspective view of an individual bag constructed according to the present invention.

Referring now to FIG. 1, a food storage bag 10 includes a generally rectangular back sheet 12 having a top edge 14, bottom edge 16, and left and right edges 18 and 20, respectively. The sheet 12 may be constructed of a film of polyethylene or polypropylene or other suitable material.

A perforation 22 parallel to the top edge 14 and positioned below the top edge 14 separates the majority of the back sheet 12 from an upper tab 24. The perforation 22 allows the tab 24 to be separated from a remaining portion 26 of the back sheet 12 by a tearing action. As will be described, the tab 24 may include elongated holes 27 that allow the tab 24 to be engaged by hooks or pins of a holder. In particular, the holes 27 are elongated along an axis parallel to the perforation 22 and may be sized to fit a variety of pin arrangements, shapes, sizes, and numbers.

A front sheet 28 is attached to a front surface of the remainder portion 26. According to one embodiment, the front sheet 28 is formed from a similar material to the back sheet 12. The front sheet 28 includes left and right edges 18' and 20', bottom edge 16' and top edge 14', which correspond to the similarly named and numbered portions of the back sheet 12. In this regard, the edges 18 and 18', 16 and16', 20 and 20' can be heat-sealed together so as to form a pouch openable by drawing the top edge 14', which is not sealed to the back sheet 12, away from the back sheet 12.

The front sheet 28 has a height that is slightly less than the height of the remainder portion 26 so as to present a flap portion 30 of the back sheet 12 extending above the top edge 14'. According to one embodiment, positioned on a front surface of the flap portion 30, above the top edge 14', is a strip of tacky adhesive 32 that extends laterally along flap portion 30. As will be described, the adhesive 32 may be used not only to seal the bag 10 by securing the flap portion 30 over the top edge 14', but may be used as part of a dispensing mechanism. Additionally or alternatively, a similar strip of tacky adhesive 32' may be positioned to extend laterally across the front surface of the front sheet 28 below the top edge 14'. It is contemplated that the adhesive 32 may be applied to the flap portion 30 and/or front sheet 28 in a known manner. Methods of preparing tacky adhesives suitable for use with the present invention are well known in the art such as described generally in U.S. Pat. Nos. 3,406,039; 5,089,320; 5,382,472; 5,993,962 and their cited references, all hereby incorporated by reference.

The use of two strips of the tacky adhesive 32 and/or 32' allow tack between an adhesive strip and non-adhesive portions of the plastic films of the front sheet 28 and/or back sheet 12 to be minimized. However, a single adhesive tack strip may be used, positioned in the place of tacky adhesive 32 or 32'. As will be described, the adhesives 32, 32' can also be used to maintain alignment of adjacent food storage bags 10 when in a stack or on a rack. That is, a single adhesive strip 32 or 32' may be used to maintain alignment of multiple bags 10 in a stack or tack and provide a means to seal the bag 10 when removed from the stack or rack. Therefore, the tacky adhesive 32, 32' may be placed on only one of the flap 30 and the front sheet 28 and, an alternative embodiment, the tacky adhesive 32, 32' may be placed on both the flap 30 and the front sheet 28 and one of the tacky adhesives 32, 32' covered with a protective strip that can be peeled away when sealing/resealing the bag 10.

Figure 2:
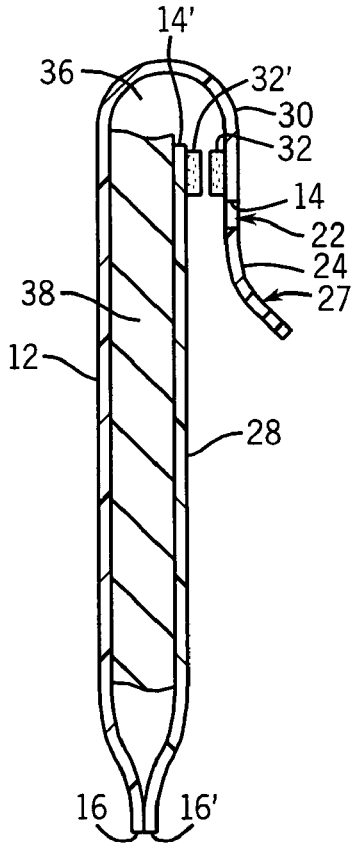
FIG. 2 is a cross section generally along lines 2-2 of FIG. 1 showing the bag in a folded down and sealed position to contain a food product therein using adhesive strips.

Referring now to FIG. 2, the flap 30 may be folded over the top edge 14' so that the strip(s) of tacky adhesive 32 and/or 32' seal the top edge 14 against the top edge 14' forming an enclosed volume 36 which may receive or have received a food 38 (FIG. 4) such as lunchmeat, cheese, or the like.

Figure 3:
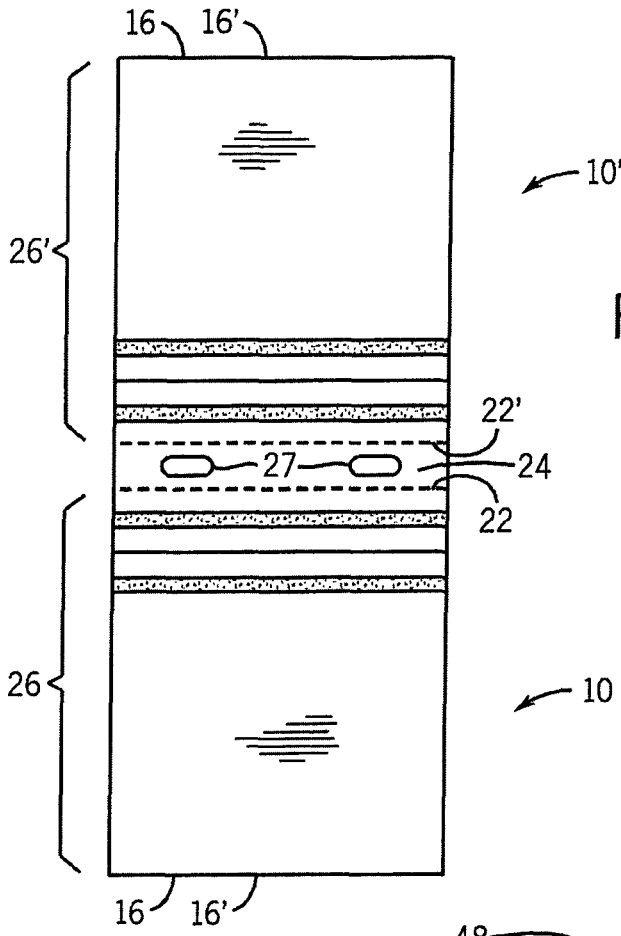
FIG. 3 is a plan view of a multi-bag system including mirrored, symmetric bags that are attached to a common central tab section.

Referring now to FIG. 3, in an alternative embodiment, the tab 24 may include both a first perforation 22 connecting the tab 24 to a first remainder portion 26 of the back sheet 12 and a second perforation 22' connecting the tab 24 to a second remainder portion 26' extending in an opposite direction from the tab 24 so that two separate food storage bags 10 and 10' may share a common tab 24.

Figure 4:
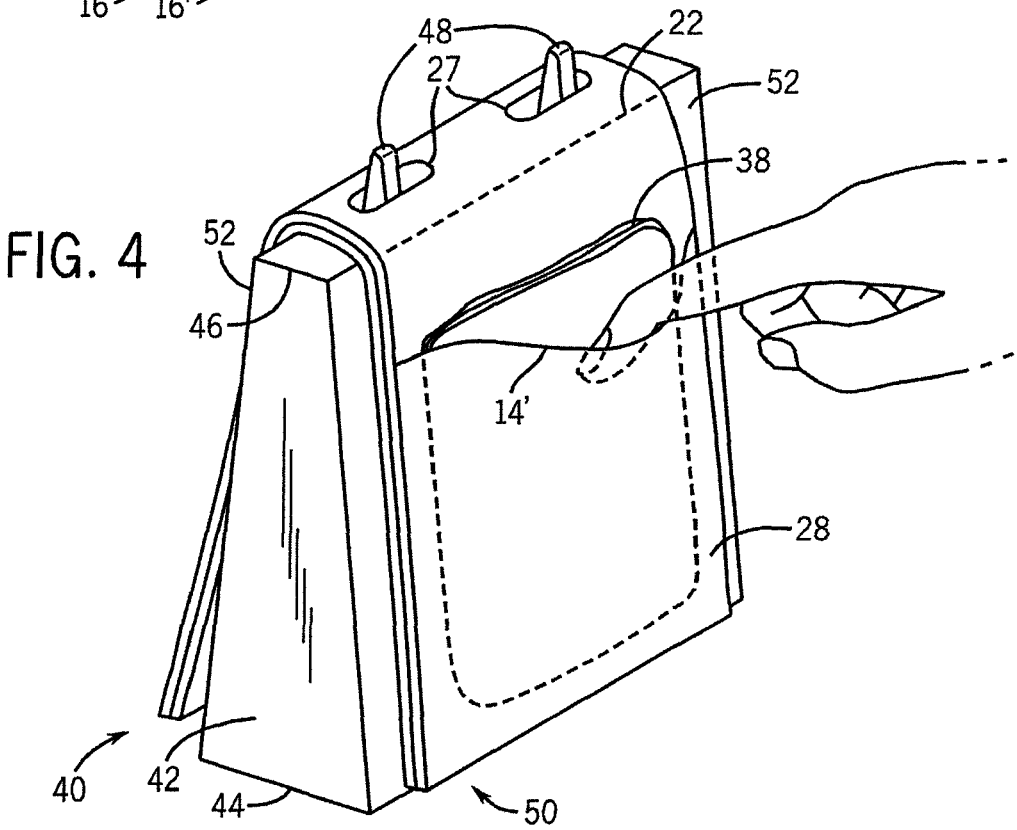
FIG. 4 is a perspective view of the bags of FIG. 3 engaged with a dispensing rack showing use by a store worker where one hand is used to open the bag and the other may be used to insert a food item therein.

As shown in FIG. 4, a counter rack 40 may include a stand portion 42 having a base 44 for resting against the counter or the like, and an upper surface 46 positioned above the base 44 by a distance greater than that between the elongated holes 27 and the bottom edges 16 and 16' of the co-joined food storage bags 10 and 10' of FIG. 3. Upwardly extending pins 48 may be received by the elongated holes 27 to retain a stack of co-joined bags 50 in a stacked configuration on opposing support faces 52 of the counter rack 40. In order to stabilize the stack of food storage bags, the connecting tabs 24 may be fused together by melting the elongated holes 27 or other holes through the stacked connecting tabs 24 or by other means.

In operation, the user may open the bag by pulling top edge 14' of one of the bags forward with one hand while the other hand is used to insert the food 38 into the pouch formed by the front and back sheets. The hand used to open the pouch may then be used to steady the rack and the other hand used to remove the bag from the rack by separating the perforations 22. The food 38 may then be sealed within the food storage bag 10, as described with respect to FIG. 2.

Figure 5:
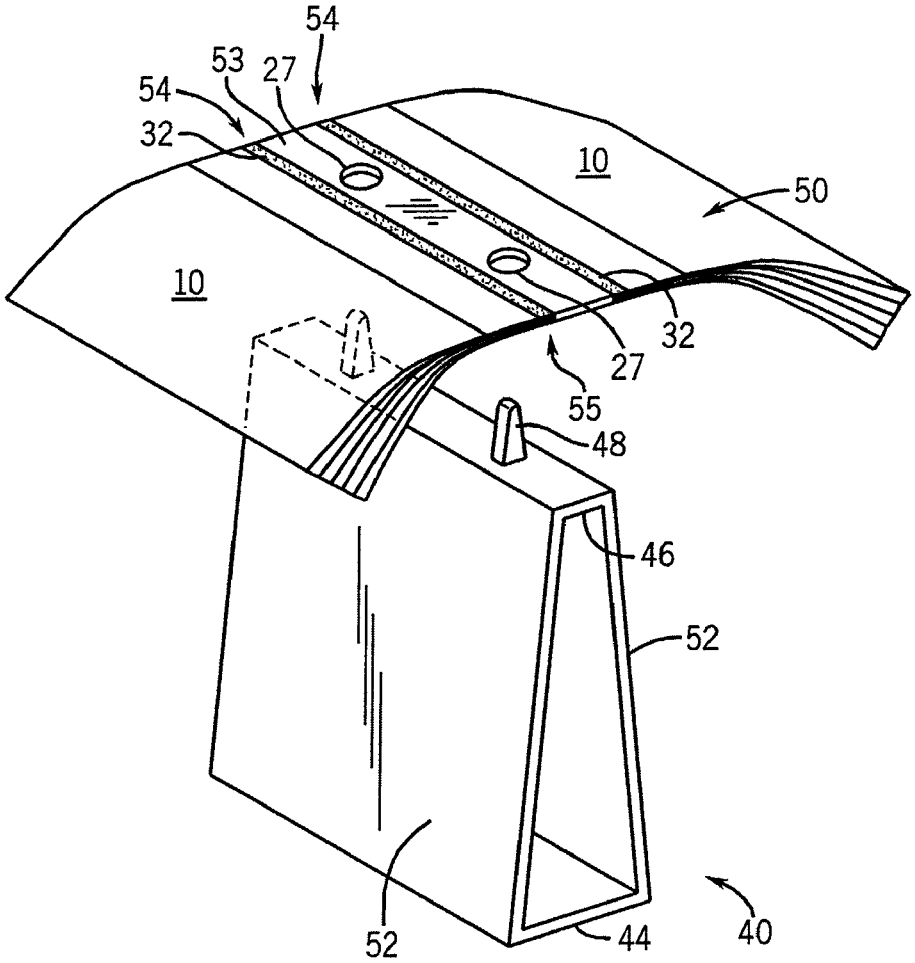
FIG. 5 is a perspective view of a stack of the mirrored bags secured by resealable adhesive strips to a common central tab and arranged for insertion on a dispensing stand.

Referring now to FIG. 5, another embodiment of the present invention includes a single saddle or connecting tab 53 that is shared by each of the mirrored bags 10, 10'. When the single connecting tab 53 is placed on the stand 40, it is held in a horizontal position with a joint portion 54 extending beyond the upper surface 46 to present a fastening edge 55 that extends onto the support faces 52 of the stand 40 and is engaged by the bags 10, 10'. As such, the bags 10, 10' are positioned to extend from the fastening edge 55 down the support faces 52 of the stand 40.

Figure 6:
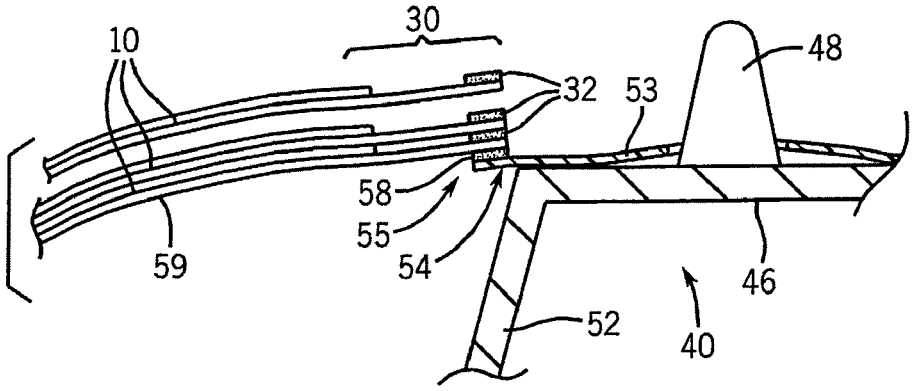
FIG. 6 is a cross-sectional view of the mirrored bags being engaged with the dispensing stand and showing the positioning of the adhesive strip and the common central tab.

As shown in FIGS. 5 and 6, the bags 10, 10' are stacked on top of one another and attached via the adhesive strip 32 to each adjacent bag. Again, the adhesive 32 is a resealable adhesive of the type well known in the art. As shown in FIG. 6, an adhesive 58 can be positioned on the fastening edge 55 of the connecting tab 53 beyond the joint portion 54 to engage an innermost bag 59 in the stack of bags 10. That is, each bag 10 is stacked with its adhesive strip engaging the bag stacked thereupon, whereby the innermost bag 59 is aligned such that it is engaged with the adhesive strip 58 positioned on the fastening edge 55 of the connecting tab 53. Therefore, the adhesive strip 32 of each bag 10, 10' is used to secure the bags 10, 10' in a stack. Within the stack, the innermost bag 59 is attached directly to the fastening edge 55 of the single connecting tab 53, a next bag is then attached directly to the innermost bag 59 through its adhesive strip, and so forth using the adhesive strips 32 of each bag. In this way, the need for a release liner for each adhesive strip 32 of each bag is eliminated, the difficulty of producing easily released perforated attachments is eliminated, and the need for a connecting tab 24 dedicated to each pair of mirrored bags 10, 10', as described with respect to FIG. 3, is eliminated. Accordingly, material and manufacturing costs are reduced.

Figure 7:
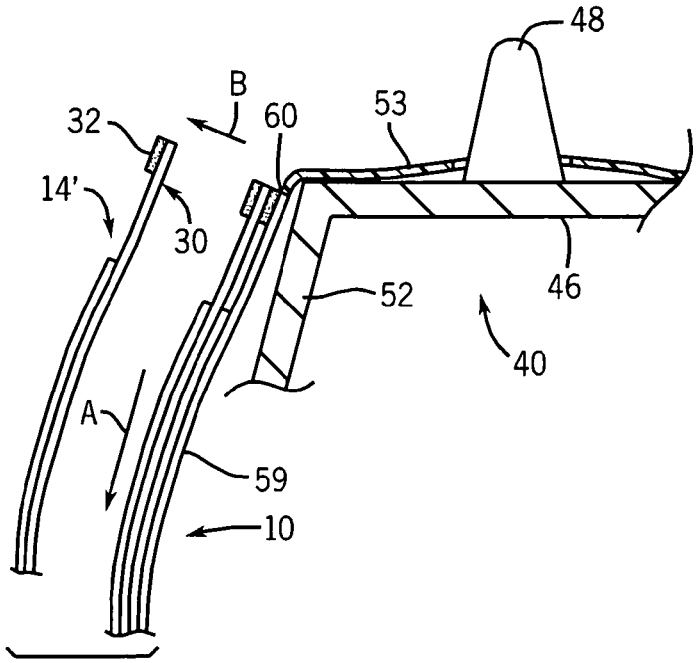
FIG. 7 is another cross-sectional view of the mirrored bags being dispensed from the dispensing stand.

Referring now to FIG. 7, another embodiment includes a perforated connection 60 that joins the connecting tab 53 with the innermost bag 59. That is, the innermost bag 59 is secured to the connecting tab 53 through a perforation 60. Therefore, connection formed by the adhesive strip 58 (FIG. 6) formed on the connecting tab 53 to join the innermost bag 59 and the connecting tab 53 can be eliminated in favor of a perforated connection 60 between the innermost bag 59 and the connecting tab 53.

Figure 8:
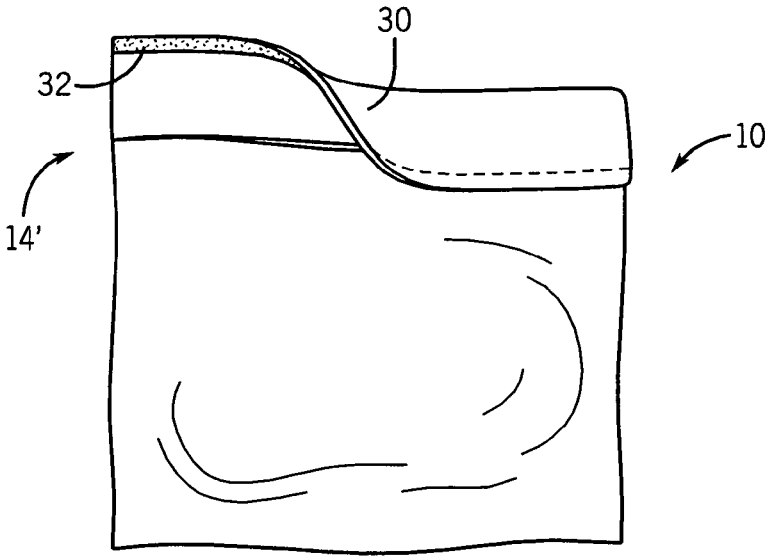
FIG. 8 is a plan view of a single bag where the adhesive strip is used to seal the bag.

Regardless of the means of connection between the innermost bag 59 and the connecting tab 53, as shown in FIGS. 7 and 8, the adhesive strip 32 of each bag in the stack 50 forms both an advantageous dispensing means and a bag sealing means. In particular, as opposed to the perforated sections described with respect to FIGS. 3 and 4, the adhesive strip 32 provides a dispensing means that resists one bag disengaging from the adjacent bag to which it is attached unless a dispensing motion is applied. That is, the orientation of the adhesive strip 32 is such that each adhesive strip 32 resists forces applied along direction A, for example, the direction of gravitational loading forces applied to the bags 10 when positioned on the stand 40. More specifically, the orientation of the bags 10 and the connecting tab 53 when positioned on the stand 40 is such that the bags 10 are secured by the adhesive 32 against vertically applied forces A that operate in shear along the plane of the bag material. On the other hand, when a peeling force is applied along direction B, the bag is easily removed from the stand 40 and the adjacent bag to which it was attached. That is, the orientation of the bags 10 and associated adhesive strips 32 is such that it is susceptible to peeling forces such as applied when a bag 10 is removed by an individual seeking to remove the bag 10 from the stand 40 and the other bags.

Therefore, as shown in FIGS. 6-8, the adhesive strip 32 performs the dual purpose of acting as an advantageous dispensing means (i.e. resisting vertical loading/sheering forces and succumbing to peeling forces) when the bags 10 are positioned on the stand 40 as well as resealably closing the bag 10 once foodstuffs are positioned therein. Specifically, as shown in FIG. 7, the adhesive strip 32 performs a dispensing function while, as shown in FIG. 8, the adhesive strip 32 secures the flap 30 in a closed position.

Additionally, it is contemplated that a bag end marking system may be incorporated into the bag system to aid in distinguishing between the ends of each bag. That is a marking system may be included to more clearly identify the seal of a particular bag so that consumers know which end of the bag is sealed and which is open. For example, the seal may have a different color then the rest of the polyethylene bag.

However, as polyethylene bags are often arranged on rolls or separated and interleaved and then wound onto rolls, it is contemplated a marking system may be employed to identify the open end of a bag dispensed from a roll from the closed end.

According to one embodiment, the heat applied in manufacturing the seal is sufficient to activate a reagent within the film of the bag. Accordingly, a color is resident under the seal to clearly demark the seal area. It is contemplated that only the heat associated with the seal temperature would be necessary to create a colored band at the location of the seal.

According to another embodiment, a band of color is printed in register on top of or integral to the seal of each bag. This process could be performed either simultaneous to or directly antecedent to application of the seal.

Thus, the present invention provides an inexpensive resealable plastic bag that can be quickly and easily dispensed from a rack or the like. The present invention also provides resealable bags using an adhesive that may be shipped and dispensed in a flat, stacked configuration using the adhesive as the means for securing the bags in position for dispensing. As such, the present invention can be assembled by a manufacturer, shipped in assembled form, stored in assembled form, and quickly and easily positioned for dispensing. The present invention also provides a low cost bag (including reduced materials over traditional bag systems) that may be shipped in high volume, yet easily filled and dispensed, even using only one hand. Additionally, the weight-balanced, two stack system can be positioned such that two deli personnel may simultaneously dispense and fill bags. For example, legacy rack systems can be used to position the system for such access by deli personnel. Therefore, the present invention provides a bag that may be used by deli personnel with minimum wasted motion and without the need to maintain separate bags and stickers.

Therefore, one embodiment of the invention includes a packaging system. The packaging system includes a plurality of plastic bags having a first plastic sheet extending from a top edge to a bottom edge and having a first side and a second side. The plurality of plastic bags also includes a second plastic sheet jointed to the first plastic sheet at a corresponding bottom edge, first side, and second side to form a pouch therebetween and having a top edge opposite the bottom edge displaced below the top edge of the first plastic sheet to form a flap extending above the top edge of the second plastic sheet to the top edge of the first plastic sheet. An adhesive strip is disposed on the flap. The packaging system also includes a connecting tab, whereby a first of the plurality of plastic bags is secured to the connecting tab via one of an adhesive strip formed on the connecting tab and a perforation and wherein the remaining of the plurality of plastic bags is stacked upon the first of the plurality of plastic bags and secured to the flap of an adjacent bag by the adhesive strip.

The present invention has been described in terms of the preferred embodiment, and it should be appreciated that many equivalents, alternatives, variations, and modifications, aside from those expressly stated, are possible and within the scope of the invention. Therefore, the invention should not be limited to a particular described embodiment.

I claim:

1. A packaging system comprising:

a plurality of plastic bags comprising:

a first plastic sheet extending from a top edge to a bottom edge and having a first side and a second side;

a second plastic sheet jointed to the first plastic sheet at a corresponding bottom edge, first side, and second side to form a pouch therebetween and having a top edge opposite the bottom edge displaced below the top edge of the first plastic sheet to form a flap extending above the top edge of the second plastic sheet to the top edge of the first plastic sheet;

an adhesive strip disposed on the flap;

a connecting tab configured to engage a generally horizontal support surface;

wherein a first of the plurality of plastic bags is secured to the connecting tab via an adhesive strip formed on a fastening edge of the connecting tab, wherein a remainder of the plurality of plastic bags is stacked upon the first of the plurality of plastic bags, and wherein each of the remainder of the plurality of plastic bags is only secured to the flap of an adjacent bag by the adhesive strip;

another plurality of plastic bags comprising:

a first plastic sheet extending from a top edge to a bottom edge and having a first side and a second side;

a second plastic sheet jointed to the first plastic sheet at a corresponding bottom edge, first side, and second side to form a pouch therebetween and having a top edge opposite the bottom edge displaced below the top edge of the first plastic sheet to form a flap extending above the top edge of the second plastic sheet to the top edge of the first plastic sheet;

an adhesive strip disposed on the flap;

wherein a first of the another plurality of plastic bags is secured to the connecting tab via another adhesive strip formed on another fastening edge of the connecting tab, wherein a remainder of the another plurality of plastic bags is stacked upon the first of the another plurality of plastic bags, wherein each of the remainder of the another plurality of plastic bags is only secured to the flap of an adjacent bag by the adhesive strip;

a stand having a upper surface configured to support the connecting tab and first and second generally vertically extending side surfaces configured to engage the plurality of plastic bags and the another plurality of plastic bags, respectively; and wherein the connecting tab includes a plastic sheet extending from the fastening edge to the another fastening edge and wherein the first of the plurality of plastic bags is secured to the fastening edge of the connecting tab and the first of the another plurality of plastic bags is secured to the another fastening edge of the connecting tab.

2. The packaging system of claim 1 wherein, upon removal of a plastic bag from the adjacent plastic bag, the flap is configured to be folded onto the second plastic sheet to engage the adhesive strip with the second plastic sheet and seal the plastic bag.

3. The packaging system of claim 1 wherein the stand is configured to position each adhesive strip to apply gravitational loading as a shear force to the adhesive strips.

4. The packaging system of claim 1 wherein the stand is an A-frame stand configured to present the plurality of plastic bags and the another plurality of plastic bags such that an outermost plastic bag stacked upon the connecting tab can be removed from an adjacent plastic bag by applying a peeling force to disengage the outermost plastic bag from the adhesive strip of the adjacent plastic bag.

5. The packaging system of claim 4 wherein the connecting tab includes at least one hole to allow at least one pin of the A-frame stand to pass therethrough to, along with gravitational loading forces, secure the plurality of plastic bags and the another plurality of plastic bags on the A-frame stand.

6. A perishable food packaging dispenser comprising:

a first plastic bag having a flap configured to fold over an entry passage into the first plastic bag and an adhesive strip disposed on the flap to secure the flap to the first plastic bag when folded over the entry passage;

a second plastic bag having a flap configured to fold over an entry passage into the second plastic bag and an adhesive strip disposed on the flap to secure the flap to the second plastic bag when folded over the entry passage;

a connecting tab extending from a first joining edge to a second joining edge wherein the first plastic bag is configured to be removeably secured to the first joining edge through an adhesive strip and the second plastic bag is configured to be removeably secured to the second joining edge through another adhesive strip;

a first stack of bags joined only to the first plastic bag through the adhesive strip of the first bag;

a second stack of bags joined only to the second plastic bag through the adhesive strip of the second bag;

a dispensing stand having a first sloped side wall and a second sloped side wall that are joined at respective upper ends by a generally horizontal upper wall; and wherein the connecting tab is configured to be disposed over the upper wall to position the first plastic bag and the first stack of plastic bags with the entry passages facing away from the first sloped side wall and the second plastic bag and the second stack of plastic bags with the entry passage facing away from the second sloped wall.

7. The perishable food packaging dispenser of claim 6 wherein each of the bags in the first stack of bags and the second stack of bags is configured to be removed from an adjacent bag by applying a peeling force directed generally away from the first and second sloped side walls.

8. The perishable food packaging dispenser of claim 6 wherein the adhesive strips of the first stack of bags and the second stack of bags are configured to resist forces applied generally along the first and second sloped side walls.

9. The perishable food packaging dispenser of claim 6 wherein each bag in the first stack of bags and the second stack of bags has a flap with an adhesive strip disposed thereon such that the flap of one plastic bag is jointed to a forwardly adjacent plastic bag through the adhesive strip of the one plastic bag and the flap of the one plastic bag is joined to a rearwardly adjacent plastic bag through the adhesive strip of the rearwardly adjacent bag.

10. The perishable food packaging dispenser of claim 6 further comprising at least one passage formed in the connecting tab to receive at least one pin extending from the upper wall of the dispensing stand.

11. A flexible package for food comprising:

a back plastic sheet having a front and rear surface;

a tab engageable with a rack;

a first adhesive strip joining the tab arid a first remainder of the back plastic sheet;

a second adhesive strip joining the tab and a second remainder of the back plastic sheet;

a first front plastic sheet having a front and rear surface and attached at side and bottom edges and not at a top edge to corresponding edges of the first remainder of the back plastic sheet with the rear surface of the first front plastic sheet adjacent to the front surface of the first remainder of the back plastic sheet to form a pouch therewith, the first front plastic sheet sized so that the top edge of the first front plastic sheet is below the first adhesive strip to leave a flap portion of the first remainder of the back plastic sheet that may fold over the edge of the first front plastic sheet to cover the top edge of the first front plastic sheet and so that the front surface of the flap portion may fold about the front portion of the first front plastic sheet to touch at a first contact area near the top edge of the first front plastic sheet;

a second front plastic sheet having a front and rear surface and attached at side and bottom edges and not at a top edge to corresponding edges of the second remainder of the back plastic sheet with the rear surface of the second front plastic sheet adjacent to the front surface of the first remainder of the back plastic sheet to form a pouch therewith, the second front plastic sheet sized so that the top edge of the second front plastic sheet is below the second adhesive strip to leave a flap portion of the second remainder of the back plastic sheet that may fold over the edge of the second front plastic sheet to cover the top edge of the second front plastic sheet and so that the front surface of the flap portion may fold about the front portion of the second front plastic sheet to touch at a second contact area near the top edge of the second front plastic sheet;

at least one third resealable adhesive strip positioned on the first contact area to resealably hold the first flap portion closed against the first front plastic sheet;

at least one fourth resealable adhesive strip positioned on the second contact area to resealably hold the second flap portion closed against the second front plastic sheet;

a first stack of bags joined only to the first remainder of the back plastic sheet and the first front plastic sheet; and a second stack of bags joined only to the second remainder of the back plastic sheet and the second front plastic sheet.

12. The flexible package for food of claim 11 wherein the first stack of bags is joined to the first contact area by the at least one third resealable adhesive strip and the second stack of bags is joined to the second contact area by the at least one fourth resealable adhesive.

* * * * *

UNITED STATES PATENT AND TRADEMARK OFFICE

CERTIFICATE OF CORRECTION

PATENT NO. : 7,806,594 B2
APPLICATION NO. : 11/260725
DATED : October 5, 2010
INVENTOR(S) : Thomas J. Trinko It is certified that error appears in the above-identified patent and that said Letters Patent is hereby corrected as shown below:

Claim 11, Column 8, Line 30: “arid” should be --and--.

Signed and Sealed this
Fourth Day of January, 2011

David J. Kappos

David J. Kappos
*Director of the United States Patent and Trademark Office*